US008434313B2

(12) United States Patent
Tschuor et al.

(10) Patent No.: US 8,434,313 B2
(45) Date of Patent: May 7, 2013

(54) THERMAL MACHINE

(75) Inventors: Remigi Tschuor, Windisch (CH); Hartmut Hähnle, Küssaberg (DE); Uwe Rüdel, Baden-Rütihof (CH)

(73) Assignee: ALSTOM Technology Ltd., Baden (CH)

( * ) Notice: Subject to any disclaimer, the term of this patent is extended or adjusted under 35 U.S.C. 154(b) by 937 days.

(21) Appl. No.: 12/540,453

(22) Filed: Aug. 13, 2009

(65) Prior Publication Data

US 2010/0037621 A1 Feb. 18, 2010

(30) Foreign Application Priority Data

Aug. 14, 2008 (CH) ..... 1277/08

(51) Int. Cl.
*F23R 3/50* (2006.01)

(52) U.S. Cl.
USPC ..... 60/804; 60/757; 60/760

(58) Field of Classification Search ..... 60/804, 60/752, 757, 758, 760
See application file for complete search history.

(56) References Cited

U.S. PATENT DOCUMENTS

| | | | | |
|---|---|---|---|---|
| 4,896,510 | A * | 1/1990 | Foltz | 60/757 |
| 5,226,278 | A * | 7/1993 | Meylan et al. | 60/755 |
| 5,388,412 | A * | 2/1995 | Schulte-Werning et al. | 60/760 |
| 5,426,943 | A * | 6/1995 | Althaus et al. | 60/760 |
| 6,430,933 | B1 * | 8/2002 | Keller | 60/760 |
| 2001/0020364 | A1 | 9/2001 | Sato et al. | |
| 2005/0144953 | A1 | 7/2005 | Martling et al. | |
| 2006/0179770 | A1 * | 8/2006 | Hodder | 52/588.1 |

FOREIGN PATENT DOCUMENTS

| | | |
|---|---|---|
| EP | 0239020 | 9/1987 |
| EP | 1219900 | 7/2002 |
| EP | 1662201 | 5/2006 |
| GB | 2434199 | 7/2007 |

OTHER PUBLICATIONS

Genzel et al, "Back to Basics S-scan Coverage with Phased Arrays" http://www.asnt.org/publications/materialseval/basics/aug08basics/aug08basics.htm, Aug. 2008, pp. 1-13.*

* cited by examiner

*Primary Examiner* — Ted Kim
(74) *Attorney, Agent, or Firm* — Cermak Nakajima LLP; Adam J. Cermak

(57) ABSTRACT

A thermal machine, especially a gas turbine, includes an annular combustor which is outwardly delimited by an outer shell and an inner shell (33) and through which a hot gas axially flows. The outer shell and inner shell (33) are each provided with a concentric cooling shroud (31) which is attached at a distance on their outer side, forming a cooling passage (32) through which cooling passage (32) cooling air flows in a direction which is opposite to the hot gas flow. The cooling of the combustor is improved by at least one of the cooling shrouds (31), on the side on which the cooling air enters the cooling passage (32), having an outwardly curved, rounded inlet edge (37) for improving the inflow conditions.

6 Claims, 6 Drawing Sheets

THERMAL MACHINE

This application claims priority under 35 U.S.C. §119 to Swiss application no. 01277/08, filed 14 Aug. 2008, the entirety of which is incorporated by reference herein.

BACKGROUND

1. Field of the Invention

The present invention relates to the field of combustion technology, and more particularly to a thermal machine gas turbine.

2. Brief Description of the Related Art

Modern industrial gas turbines (IGT) as a rule are designed with annular combustors. In most cases, smaller IGTs are constructed with so-called "can-annular combustors". In the case of an IGT with annular combustors, the combustion chamber is delimited by the side walls and also by the inlet and discharge planes of the hot gas. Such a gas turbine is shown in FIGS. 1 and 2. The gas turbine 10 which is shown in the detail in FIGS. 1 and 2 has a turbine casing 11 in which a rotor 12 which rotates around an axis 27 is housed. On the right-hand side, a compressor 17 for compressing combustion air and cooling air is formed on the rotor 12, and on the left-hand side a turbine 13 is arranged. The compressor 17 compresses air which flows into a plenum 14. In the plenum, an annular combustor 15 is arranged concentrically to the axis 27 and, on the inlet side, is closed off by a front plate 19 which is cooled with front plate cooling air 20, and on the discharge side is in communication, via a hot gas passage 25, with the inlet of the turbine 13.

Burners 16, which for example are designed as double-cone burners or EV-burners and inject a fuel-air mixture into the combustor 15, are arranged in a ring in the front plate 19. The hot air flow 26 which is formed during the combustion of the mixture reaches the turbine 13 through the hot gas passage 25 and is expanded in the turbine, performing work. The combustor 15 with the hot gas passage 25 is enclosed on the outside, with a space, by an outer and inner cooling shroud 21 or 31 which, by fastening elements 24, are fastened on the combustor 15, 25 and between themselves and the combustor 15, 25 form an annular outer and inner cooling passage 22 or 32 in each case. In the cooling passages 22, 32, cooling air flows in the opposite direction to the hot gas flow 26 along the walls of the combustor 15, 25 into a combustor dome 18, and from there flows into the burners 16 or, as front plate cooling air 20, flows directly into the combustor 15.

The side walls of the combustor 15, 25 in this case are constructed either as shell elements or as complete shells (outer shell 23, inner shell 33). When using complete shells, the necessity of a parting plane (29 in FIG. 2*a*) arises for installation reasons, which allows an upper half of the shell 23, 33 (upper half-shell 33*a* in FIG. 2*a*) to be detached from the lower half (lower half-shell 33*b* in FIG. 2*a*), for example in order to install or to remove the gas-turbine rotor 12. The parting plane 29 correspondingly has two parting plane welded seams 30 (FIG. 2*a*) which, in the example of the type GT13E2 gas turbine constructed by ALSTOM, are located at the level of the machine axis 27 (3 o'clock and 9 o'clock positions).

As already mentioned, the lower and upper half-shells 33*a*, 33*b* must be convectively cooled in each case. In order to promote the cooling, the already mentioned cooling shrouds (co-shirts) 21 and 31 are mounted on the half-shell cold side and deflect ambient air and, on account of the combustor pressure drop or burner pressure drop, guide the ambient air over the half-shells and as a result bring about convective cooling.

The cooling shrouds 21, 31 in this case preferably have the following characteristics and functions:

- they seal two plenums or chambers;
- they must also seal in relation to each other (requiring installation of a sealing lip or overlap);
- they are axially-symmetrically constructed, with exception of the parting plane 29;
- during installation of the combustor half-shells they must be guided one inside the other in the parting plane;
- the cooling shrouds 31 of the combustor inner shells 33*a, b* must be guided one inside the other on the parting plane 29 in a "blind" manner (no access for a visual inspection of the connecting plane, on account of being covered by the combustor inner shells);
- they are able to have cooling holes (for a specific mass flow of cooling air);
- they are able to have cooling holes for a possible impingement cooling (for a specific, locally forced cooling of the half-shells);
- they must not absorb large axial or radial forces;
- they are as a rule not self-supporting, but are mounted on a supporting component;
- they must have a large axial and radial movement clearance, especially during transient operating states;
- they must be resistant to temperature (fatigue strength-creep strength);
- they must be simply and inexpensively producible; and
- they are not permitted to have natural vibrations during operation.

The inner and outer shells 33 or 23 of a gas turbine such as GT13E2 are thermally and mechanically highly stressed during operation. The strength properties of the material of the shells 23, 33 are greatly dependent upon temperature. In order to keep the material temperature below the maximum permissible material temperature level, the shells 23, 33 are convectively cooled. The profiling and the high thermal load close to the turbine inlet (hot gas passage 25) require above all a constantly high heat transfer in this region, even on the cooling air side. This is achieved by impingement cooling in the case of the outer shell 23. Space and flow conditions, and also sealing against a crossflow, are not provided on the inner shell 33 for such impingement cooling. Therefore, conventional convection cooling is resorted to, in which the intensity of the cooling is increased by reduction of the passage height of the cooling passage 32.

The previously used configuration of the inner cooling shroud 31, having two axial plates, on the one hand is contingent upon spacing tolerances and other irregularities, for example in the flow field upstream of the cooling air inlet into the cooling passage, and on the other hand brings about an undesirable reduction of the mass flow of cooling air in the region of the smaller of the two axial plates.

SUMMARY

One of numerous aspects of the present invention includes a thermal machine in which the flow conditions of the cooling air in the cooling passages between the shells and the cooling shrouds in the sense of an intensive cooling are significantly improved.

Another aspect of the present invention includes that at least one of the cooling shrouds, on the side on which the cooling air enters the cooling passage, has an outwardly curved, rounded inlet edge for improving the inflow conditions. The at least one cooling shroud is widened out in the region of the inlet edge preferably in a bellmouth-shaped or flared manner.

Another aspect includes that the inner cooling shroud, on the side on which the cooling air discharges from the cooling passage, has an outwardly curved, rounded discharge edge for reducing the flow losses.

According to yet another aspect of the invention, the cooling shrouds are assembled from individual cooling shroud segments which adjoin each other in the circumferential direction, wherein the cooling shroud segments are fastened on the associated shells by fastening elements which are arranged in a distributed manner.

A preferred development includes that the cooling shroud segments overlap each other in pairs in the adjoining regions, and that a cooling shroud segment of a pair is each equipped in the overlapping region with overlapping elements for a form-fitting connection between the overlapping cooling shroud segments.

Another aspect of the invention includes that the fastening elements in the case of the cooling shroud segments are each axially arranged one behind the other, and in that additional holes are provided in the cooling shroud segments in axial alignment with the fastening elements, through which cooling air flows in in jets from outside into the respective cooling passage for improving the cooling.

A further aspect of the invention includes that the combustor is split in a parting plane into an upper half with upper half-shells and a lower half with lower half-shells, in that the half-shells are interconnected in the parting plane by parting plane welded seams, in that the shells in the region of the parting plane welded seams have a shape which deviates from the axial symmetry, and in that the cooling shrouds in the parting plane are adapted to the deviating shape of the shells.

The entirety of the cooling shroud segments is preferably divided into first cooling shroud segments which are adjacent of the parting plane, and second cooling shroud segments which lie outside the parting plane, wherein the first cooling shroud segments have a raised side edge for adapting to the deviating shape of the shells.

BRIEF DESCRIPTION OF THE DRAWINGS

The invention is to be subsequently explained in more detail based on exemplary embodiments in conjunction with the drawing. In the drawing

DETAILED DESCRIPTION OF EXEMPLARY EMBODIMENTS

Figure 1:
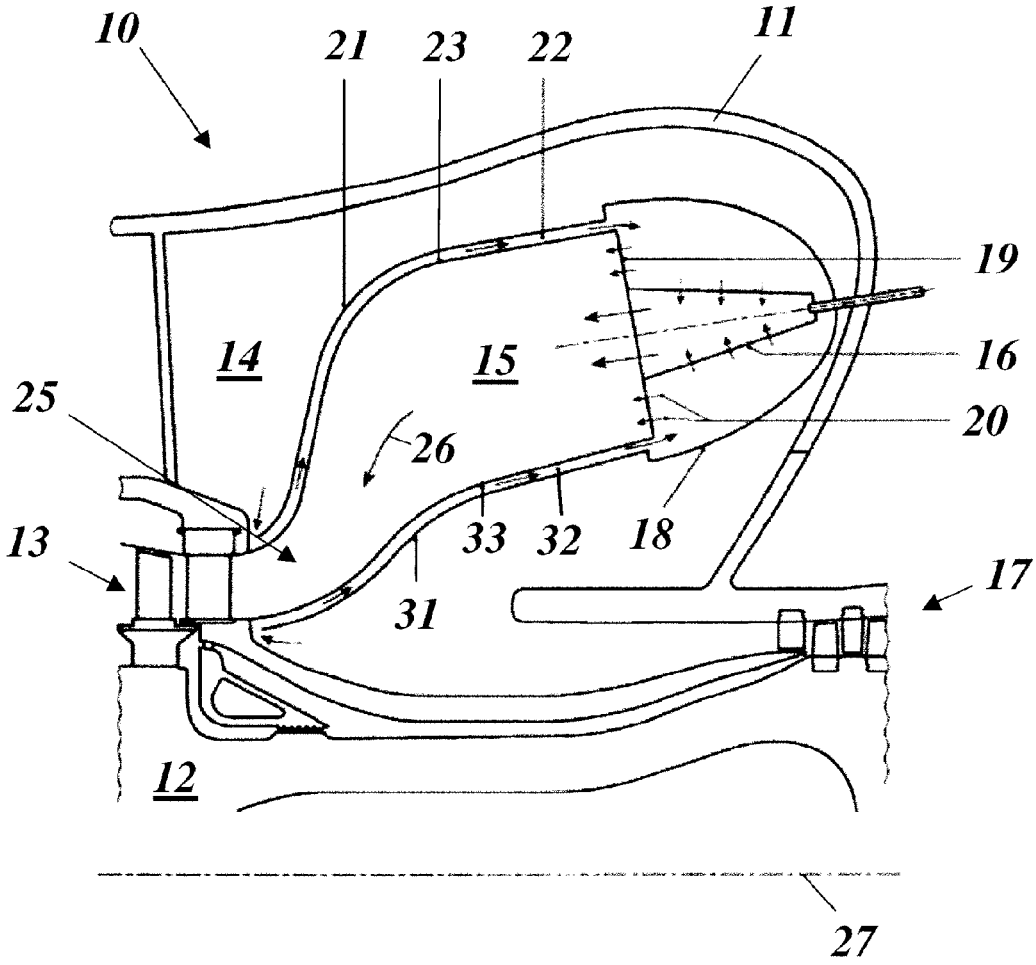
FIG. 1 (Prior Art)
FIG. 1 shows the longitudinal section through a cooled annular combustor of a gas turbine according to the prior art.
Figure 2:
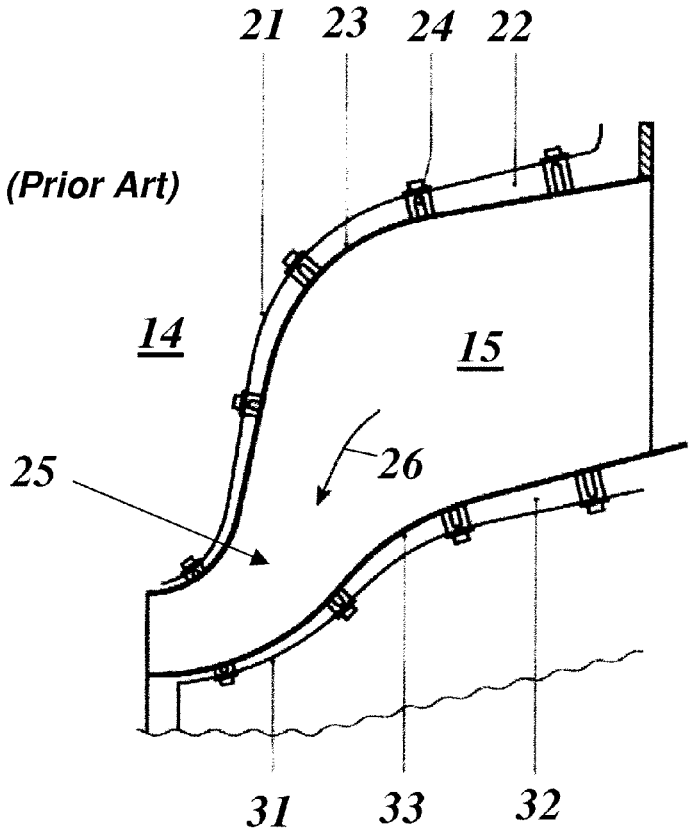
FIG. 2 (Prior Art)
FIG. 2 shows in detail the annular combustor from FIG. 1 with the cooling shrouds fastened on the outside.
Figure 2A:
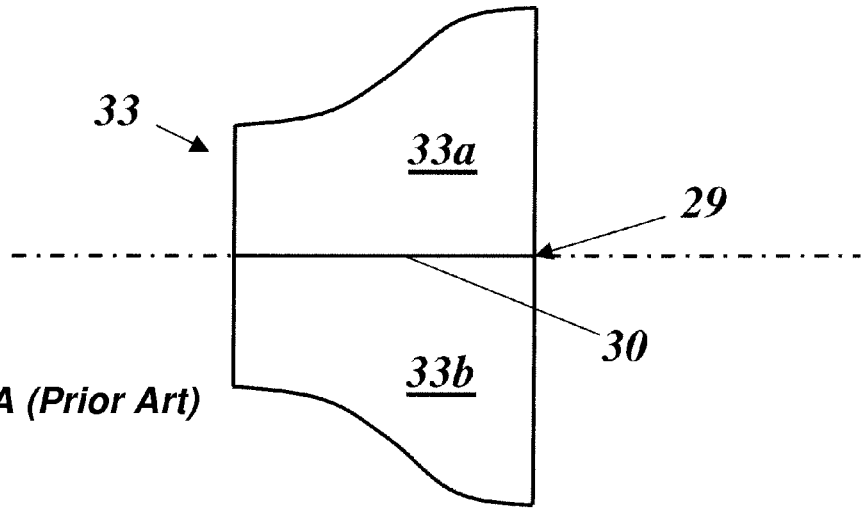
FIG. 2A (Prior Art)
FIG. 2*a* shows in a schematic arrangement in an example of the inner shell the division of the combustor shells in a parting plane into two half-shells.
Figure 3:
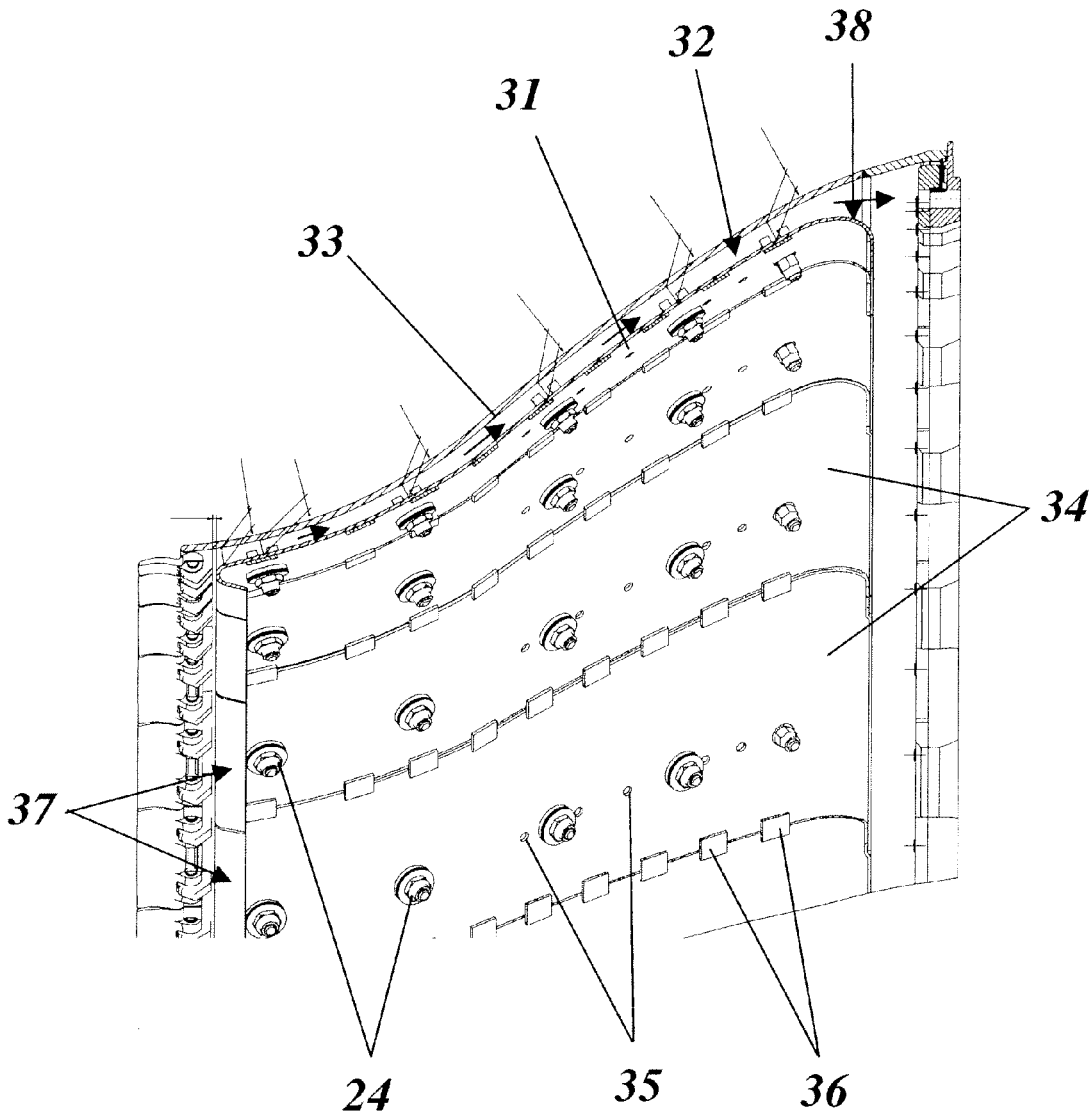
FIG. 3 shows in a side view the part of an inner shell with segmented cooling shroud according to an exemplary embodiment of the invention.
Figure 7:
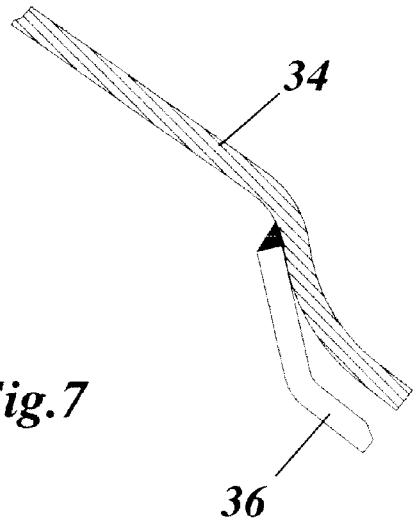
FIG. 7 shows in a detail the arrangement of the overlapping elements on the cooling shroud segment from FIG. 5 or 6.

In FIG. 3, the part of an inner shell with segmented cooling shroud according to an exemplary embodiment of the invention is reproduced in a side view. For cooling the inner shell 33, an annular cooling passage 32 is formed on the outer side of the inner shell 33 by an inner cooling shroud 31 which is concentrically arranged at a distance from it, into which cooling passage cooling air flows in on the left-hand side in FIG. 3, flows to the right, and on the right-hand side leaves the cooling passage 32 again (see flow arrows in FIG. 3). The inner cooling shroud 31 is assembled from individual cooling shroud segments 34 which extend in the axial direction and adjoin each other in an overlapping manner. In the overlapping region, overlapping elements 36 which project on the edge side are welded on the cooling shroud segments 34 (see especially FIG. 7) and in the overlapping region provide for a form-fit between the overlapping segments.

Figure 5:
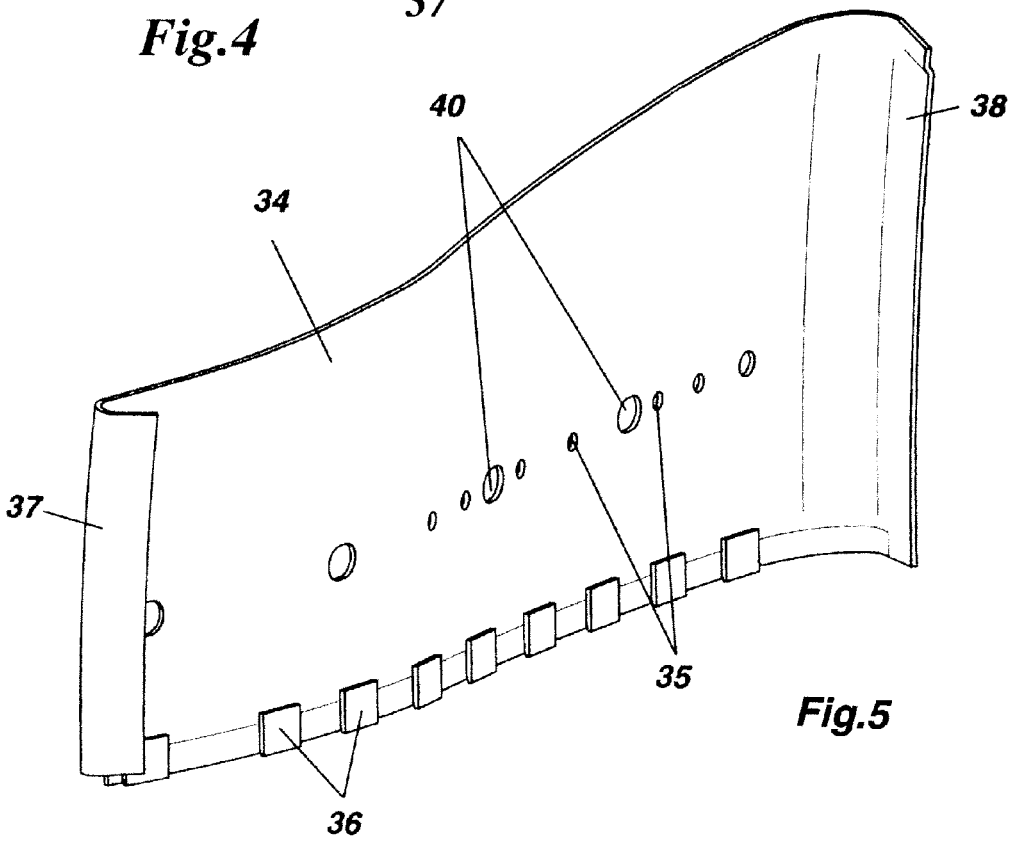
FIG. 5 shows a cooling shroud segment of the exemplary embodiment from FIG. 3 which is not adjacent to the parting plane.
Figure 6:
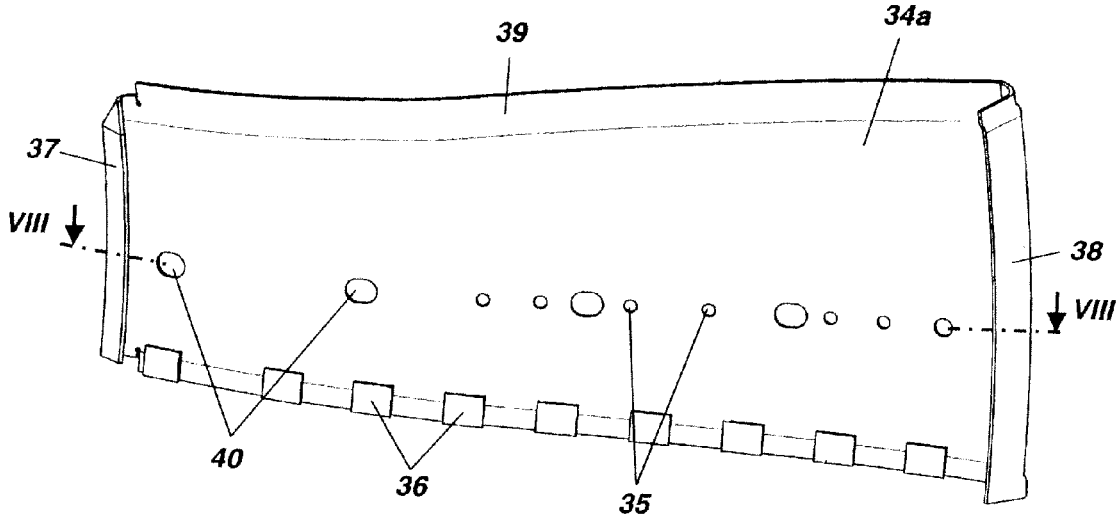
FIG. 6 shows a cooling shroud segment of the exemplary embodiment from FIG. 3 which is adjacent to the parting plane, with the special side edge.
Figure 8:
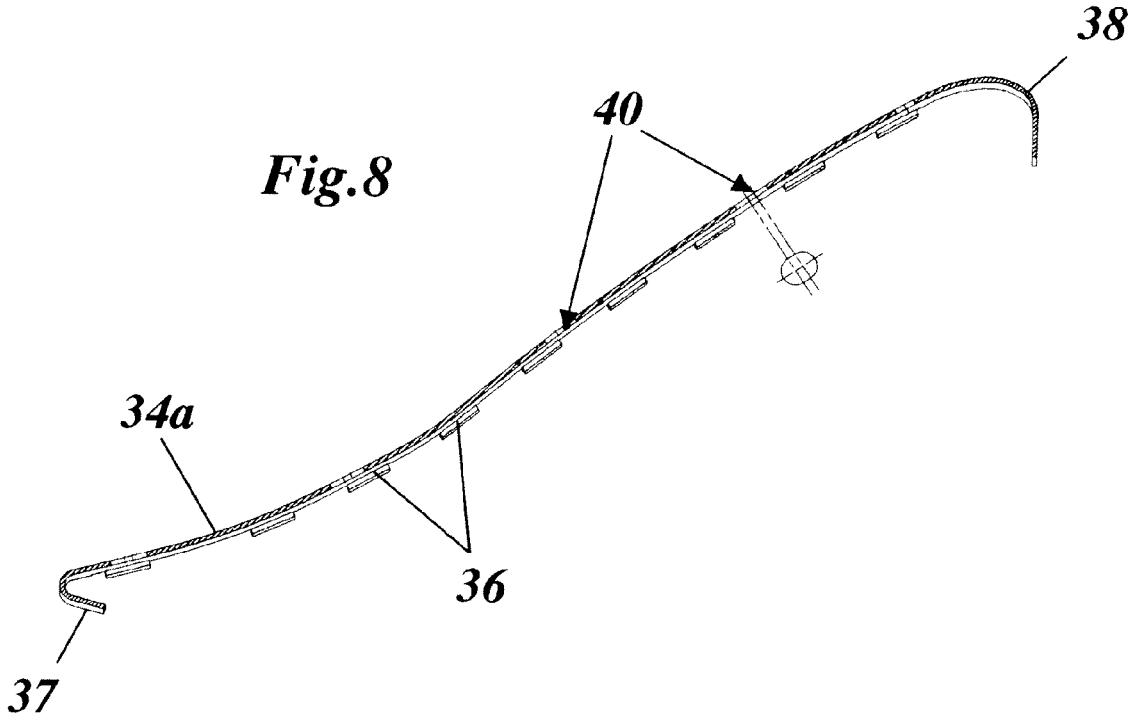
FIG. 8 shows the longitudinal section through the cooling shroud segment from FIG. 6 in the plane VIII-VIII which is drawn in there.

The cooling shroud segments 34 are fastened on the associated inner shell 33 by fastening elements 24 which are arranged in a distributed manner and pass through fastening holes 40 in the segments (FIGS. 5, 6 and 8). The fastening elements 24 in this case are arranged one behind the other in the axial direction. In axial alignment with the fastening elements 24, in the following region of the fastening elements 24, additional holes 35 are provided in the cooling shroud segments 34 through which air flows in from the cooling air inlet. The air jet which enters the cooling passage 32, on account of its locally high velocity with regard to the incoming mass flow of cooling air, leads to an increase of the heat transfer coefficient and therefore to a reduction of the wall temperature of the inner shell 33.

The inner cooling shroud 31 is widened out in the region of the inlet edge 37 in a bellmouth-shaped or flared manner. This rounded "bellmouth-shaped" inlet edge 37 of the cooling air plate, which is in one piece in the axial direction, on the one hand allows the pressure loss at the cooling air inlet to be minimized, and on the other hand allows an (inadvertent) variation of the heat transfer coefficient as a result of separation of the cooling air at the cooling passage inlet (inlet edge 37), such as occurs on sharp-edged inlets, to be prevented. The reductions of the vortex losses which are achieved as a result of the improved inflow conditions lead to a reduction of the necessary mass flow of cooling air and therefore to a more efficient mode of operation of the combustor. The flow direction of the cooling air in this case is opposite to the hot gas flow direction.

The inner-shell cooling shroud or inner cooling shroud 31 is furthermore constructed so that on its outer side (discharge edge 38) a transition radius is newly selected which creates an essentially more favorable, i.e., lower, flow loss than the previous configuration. The reduction in flow loss at this point is compensated for by a reduction of the cooling passage height, which again leads to an increase of the cooling air-side heat transfer there and therefore to a lowering of the mean material temperature of the inner shell 33.

The cooling shroud segments 34:

- can be, but do not have to be, constructed as plates (rolled material);
- they must seal in relation to each other, installation of a sealing lip or overlap (overlapping elements 36) being necessary;

are axially-symmetrically constructed, with exception of the cooling shroud segments 34*a* which are adjacent to the parting plane 29;

can have cooling holes 35 (for a specific mass flow of cooling air); and must be resistant to temperature (fatigue strength-creep strength).

Figure 4:
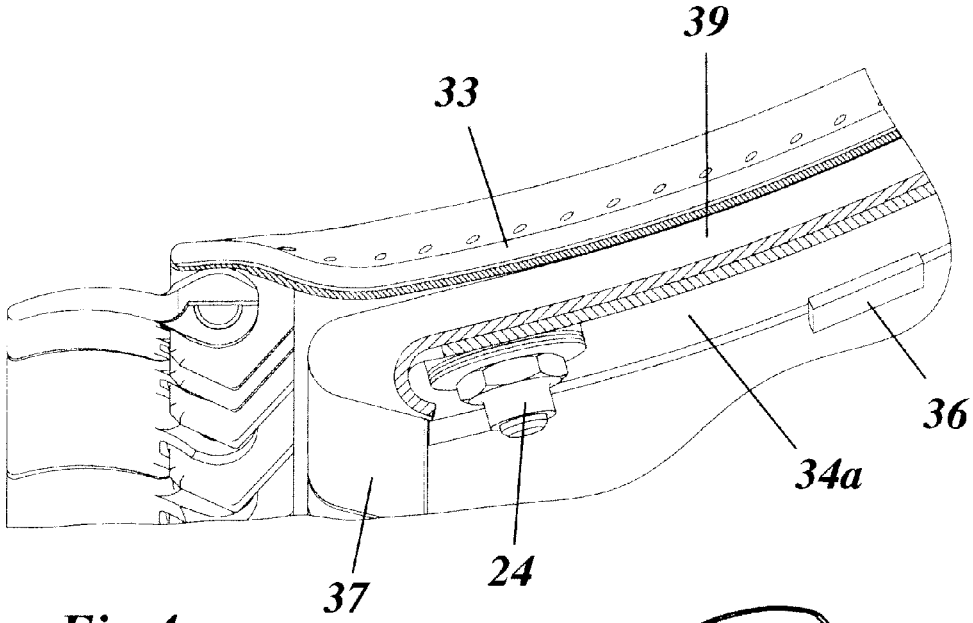
FIG. 4 shows an enlarged detail of the exemplary embodiment from FIG. 3 with the special configuration of the cooling shroud segment which is adjacent to the parting plane.

As is to be seen in FIG. 4 and FIG. 6, the cooling shroud segments 34*a* which are adjacent to the parting plane 29 have a raised or outwards extended side edge 39. As a result, the cooling shroud 31 in the region of the parting plane welded seam 30 recedes outwards and creates space for a corresponding convexity of the combustor shell 33 in the region of the parting plane welded seam 39.

LIST OF DESIGNATIONS

10 Gas turbine
11 Turbine casing
12 Rotor
13 Turbine
14 Plenum
15 Combustor
16 Burner (double-cone burner or EV-burner)
17 Compressor
18 Combustor dome
19 Front plate
20 Front plate cooling air
21 Outer cooling shroud
22 Outer cooling passage
23 Outer shell
24 Fastening element
25 Hot gas passage
26 Hot gas flow
27 Axis
29 Parting plane
30 Parting plane welded seam
31 Inner cooling shroud
32 Inner cooling passage
33 Inner shell
33*a* Upper half-shell (inner shell)
33*b* Lower half-shell (inner shell)
34 Cooling shroud segment
34*a* Cooling shroud segment (parting plane)
35 Hole
36 Overlapping element
37 Inlet edge (rounded, "bellmouth-shaped")
38 Discharge edge (rounded)
39 Side edge (raised)
40 Fastening hole While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A thermal machine comprising:

an annular combustor having and outwardly delimited by an outer shell and an inner shell and through which a hot gas flow can axially flow;

wherein the outer shell and inner shell each comprise a concentric cooling shroud attached at a distance on outer sides of the outer and inner shells and forming a cooling passage therebetween through which cooling passage cooling air can flow in a direction opposite to the hot gas flow;

wherein at least one of the cooling shrouds, on a side at which cooling air enters the cooling passage, has an outwardly curved, rounded inlet edge configured and arranged to improve inflow conditions;

wherein the cooling shrouds comprise and are assembled from individual cooling shroud segments which circumferentially adjoin each other, and further comprising distributed fastening elements which fasten the cooling shroud segments on the associated shells; and wherein all the cooling shroud segments are divided into first cooling shroud segments which are adjacent of the parting plane, and second cooling shroud segments which lie outside the parting plane, and wherein the first cooling shroud segments have a raised side edge configured and arranged to adapt to the deviating shape of the shells.

2. The thermal machine as claimed in claim 1, wherein the at least one cooling shroud is widened out in the region of the inlet edge in a bellmouth-shaped or flared manner.

3. The thermal machine as claimed in claim 2, wherein the inner cooling shroud, on a side at which the cooling air discharges from the cooling passage, has an outwardly curved, rounded discharge edge configured and arranged to reduce flow losses.

4. The thermal machine as claimed in claim 1, wherein the cooling shroud segments overlap each other in pairs in adjoining regions, and wherein a cooling shroud segment of each pair of shroud segments further comprises overlapping elements forming a form-fitting connection between overlapping cooling shroud segments.

5. The thermal machine as claimed in claim 1, wherein the fastening elements are arranged axially one behind the other, and further comprising additional holes in the cooling shroud segments in axial alignment with the fastening elements through which cooling air jets can flow in from outside into the respective cooling passage for improving cooling.

6. The thermal machine as claimed in claim 1, wherein the combustor is split in a parting plane into an upper half with upper half-shells and a lower half with lower half-shells;

wherein the half-shells are interconnected in the parting plane by parting plane welded seams;

wherein the shells in the region of the parting plane welded seams have a shape which deviates from the axial symmetry; and wherein the cooling shrouds in the parting plane are adapted to the deviating shape of the shells.

* * * * *